US010907415B2

(12) United States Patent
Gan et al.

(10) Patent No.: US 10,907,415 B2
(45) Date of Patent: Feb. 2, 2021

(54) MULTIPLE RIDGE CUTTING ELEMENT

(71) Applicant: Smith International, Inc., Houston, TX (US)

(72) Inventors: Xiaoge Gan, Houston, TX (US); Huimin Song, Spring, TX (US); Jason Gregg, Conroe, TX (US); Sandeep Tammineni, Dhahran (SA)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 16/089,401

(22) PCT Filed: Mar. 22, 2017

(86) PCT No.: PCT/US2017/023509
§ 371 (c)(1),
(2) Date: Sep. 28, 2018

(87) PCT Pub. No.: WO2017/172431
PCT Pub. Date: Oct. 5, 2017

(65) Prior Publication Data

US 2019/0112877 A1 Apr. 18, 2019

Related U.S. Application Data

(60) Provisional application No. 62/316,453, filed on Mar. 31, 2016.

(51) Int. Cl.
*E21B 10/42* (2006.01)
*E21B 10/54* (2006.01)
(Continued)

(52) U.S. Cl.
CPC ..... *E21B 10/5673* (2013.01); *E21B 10/42* (2013.01); *E21B 10/54* (2013.01); *E21B 10/55* (2013.01)

(58) Field of Classification Search
CPC ..... E21B 10/42; E21B 10/54; E21B 10/55; E21B 10/5673
See application file for complete search history.

(56) References Cited

U.S. PATENT DOCUMENTS 4,872,520 A * 10/1989 Nelson ..... E21B 10/5673 175/430
4,984,642 A * 1/1991 Renard ..... E21B 10/5673 175/430

(Continued)

FOREIGN PATENT DOCUMENTS

CN 103857486 A 6/2014
WO WO2013040123 A1 3/2012

OTHER PUBLICATIONS

International Search Report and Written Opinion issued in International Patent Application No. PCT/US2017/023509 dated Jun. 26, 2017, 22 pages.

(Continued)

*Primary Examiner* — Matthew R Buck

(57) ABSTRACT

A cutting element may include a substrate; and an ultrahard layer on the substrate, the ultrahard layer including a non-planar working surface that is surrounded by a peripheral edge having a varying height around a circumference of the cutting element, the working surface also having: a plurality of cutting crests extending from an elevated portion of the peripheral edge across at least a portion of the working surface; at least one valley between the plurality of cutting crests; and a canted surface extending laterally from each of the outer plurality of cutting crests towards a depressed portion of the peripheral edge, a height between the depressed portion and the elevated portion being greater than a height between the elevated portion and the valley.

20 Claims, 9 Drawing Sheets

(51) Int. Cl.
*E21B 10/55* (2006.01)
*E21B 10/567* (2006.01)

(56) References Cited

U.S. PATENT DOCUMENTS

| | | | | |
|---|---|---|---|---|
| 6,045,440 | A * | 4/2000 | Johnson | E21B 10/5673 451/540 |
| 7,757,785 | B2 * | 7/2010 | Zhang | E21B 10/5673 175/430 |
| 9,604,290 | B2 | 3/2017 | Kisselbach et al. | |
| 2004/0163851 | A1 | 8/2004 | McDonough et al. | |
| 2006/0210364 | A1 | 9/2006 | Bellmann et al. | |
| 2011/0266070 | A1 * | 11/2011 | Scott | E21B 10/46 175/428 |
| 2014/0284117 | A1 | 9/2014 | Patel | |
| 2015/0122553 | A1 * | 5/2015 | Hall | E21B 10/5673 175/430 |
| 2015/0259988 | A1 * | 9/2015 | Chen | E21B 10/5673 175/430 |

OTHER PUBLICATIONS

International Preliminary Report on Patentability issued in International Patent application PCT/US2017/023509 dated Oct. 11, 2018, 14 pages.
First Office Action and Search Report issued in Chinese patent application 201780021778.2 dated Nov. 12, 2019, 22 pages.
Second Office Action and Search Report issued in Chinese patent application 201780021778.2 dated Aug. 11, 2020, 16 pages.

* cited by examiner

MULTIPLE RIDGE CUTTING ELEMENT

CROSS-REFERENCE TO RELATED APPLICATIONS

This application claims the benefit of, and priority to, U.S. Patent Application No. 62/316,453, filed on Mar. 31, 2016 and titled "Multiple Ridge Cutting Element and Tools Incorporating the Same," which application is incorporated herein by this reference in its entirety.

BACKGROUND

There are several types of downhole cutting tools, such as drill bits, including roller cone bits, hammer bits, and drag bits, reamers and milling tools. Roller cone rock bits include a bit body adapted to be coupled to a rotatable drill string and include at least one "cone" that is rotatably mounted to a cantilevered shaft or journal. Each roller cone in turn supports a plurality of cutting elements that cut and/or crush the wall or floor of the borehole and thus advance the bit. The cutting elements, either inserts or milled teeth, contact with the formation during drilling. Hammer bits generally include a one piece body having a crown. The crown includes inserts pressed therein for being cyclically "hammered" and rotated against the earth formation being drilled.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. There are, however, different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (generally made of polycrystalline diamond material or polycrystalline boron nitride material) deposited onto or otherwise bonded to a substrate are known in the art as polycrystalline diamond compact ("PDC") bits.

An example of a drag bit having a plurality of cutting elements with ultrahard working surfaces is shown in FIG. 1. The drill bit 100 includes a bit body 110 having a threaded upper pin end 111 and a cutting end 115. The cutting end 115 generally includes a plurality of ribs or blades 120 arranged about the rotational axis (also referred to as the longitudinal or central axis) of the drill bit and extending radially outward from the bit body 110. Cutting elements or cutters 150 are embedded in the blades 120 at predetermined angular orientations and radial locations relative to a working surface and with a desired back rake angle and side rake angle against a formation to be drilled.

FIG. 2 shows an example of a cutting element 150, where the cutting element 150 has a cylindrical cemented carbide substrate 152 having an end face or upper surface referred to herein as a substrate interface surface 154. An ultrahard material layer 156, also referred to as a cutting layer, has a top surface 157, also referred to as a working surface, a cutting edge 158 formed around the top surface, and a bottom surface, referred to herein as an ultrahard material layer interface surface 159. The ultrahard material layer 156 may be a polycrystalline diamond or polycrystalline cubic boron nitride layer. The ultrahard material layer interface surface 159 is bonded to the substrate interface surface 154 to form an interface between the substrate 152 and ultrahard material layer 156.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting element that includes a substrate; and an ultrahard layer on the substrate, the ultrahard layer including a non-planar working surface that is surrounded by a peripheral edge having a varying height around a circumference of the cutting element, the working surface also having: a plurality of cutting crests extending from an elevated portion of the peripheral edge across at least a portion of the working surface; at least one valley between the plurality of cutting crests; and a canted surface extending laterally from each of the outer plurality of cutting crests towards a depressed portion of the peripheral edge, a height between the depressed portion and the elevated portion being greater than a height between the elevated portion and the valley.

In another aspect, embodiments disclosed herein relate to a cutting element that includes a substrate; and an ultrahard layer on the substrate, the ultrahard layer including a non-planar working surface that is surrounded by a peripheral edge having a varying height around a circumference of the cutting element, the working surface also having: at least one cutting crest extending from an elevated portion of the peripheral edge across the working surface to another elevated portion of the peripheral edge, wherein a width spanned by the least one cutting crest ranges from 10% to 70% of the width of the substrate.

In another aspect, embodiments disclosed herein relate to a cutting element that includes a substrate; and an ultrahard layer on the substrate, the ultrahard layer including a non-planar working surface that is surrounded by a peripheral edge having a varying height around a circumference of the cutting element, the working surface also having: a plurality of cutting crests extending from an elevated portion of the peripheral edge across the working surface to another elevated portion of the peripheral edge; and at least one valley between the plurality of cutting crests, wherein crest lines extending through each of the plurality of cutting crests are on distinct planes from one another.

In yet another aspect, embodiments disclosed herein relate to a cutting element that includes a substrate; and an ultrahard layer on the substrate, the ultrahard layer including a non-planar working surface that is surrounded by a peripheral edge having a varying height around a circumference of the cutting element, the working surface also having: a plurality of cutting crests, each having a crest line extending through a length thereof; at least one valley between the plurality of cutting crests, each valley having a valley line or curve extending through a length thereof, the valley line or curve being angled relative to the crest line.

In yet another aspect, embodiments disclosed herein relate to cutting tool having a tool body and any of the cutting elements described herein included on the tool body.

Other aspects and features of the claimed subject matter will be apparent from the following description and the appended claims.

DETAILED DESCRIPTION

In one aspect, embodiments disclosed herein relate to cutting elements having a non-planar working surface. Specifically, some embodiments are directed to cutting elements having non-planar working surfaces including multiple cutting crests or ridges thereon. Some embodiments are directed to cutting elements having non-planar working surfaces with at least one cutting crest or ridge that distributes the applied load during cutting. In some embodiments, the cutting elements are used with downhole drill bits, reamers, mills, hole openers, or other downhole cutting tools.

Cutting elements of the present disclosure may include rotatable cutting elements, i.e., cutting elements that are rotatable around their longitudinal axis and relative to a downhole tool to which the cutting elements are secured. In other embodiments, the cutting elements may include fixed cutting elements that are not rotatable, but are instead are rotationally fixed into a position on a cutting tool.

Figure 3:
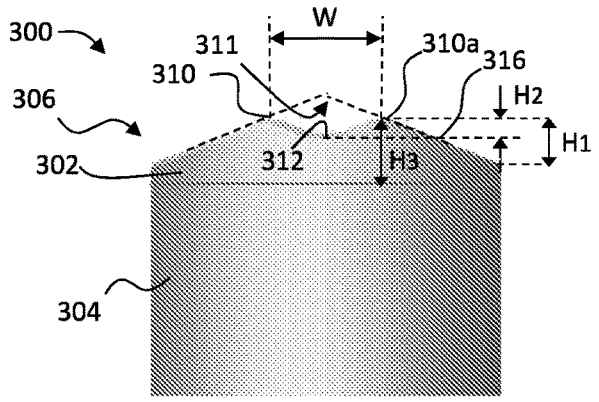
FIGS. 3-5 are various views of a cutting element, according to some embodiments of the present disclosure.
Figure 4:
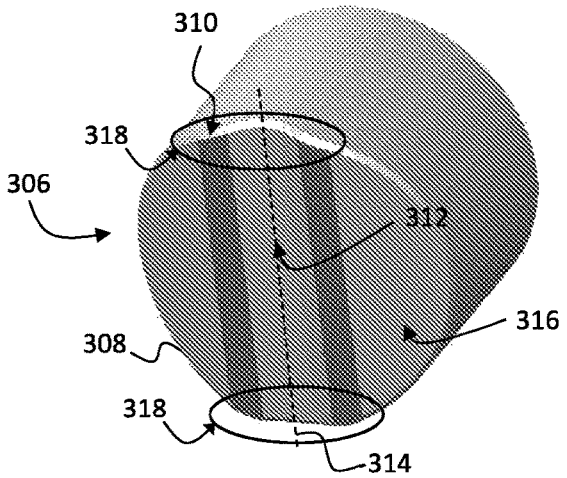
Figure 5:
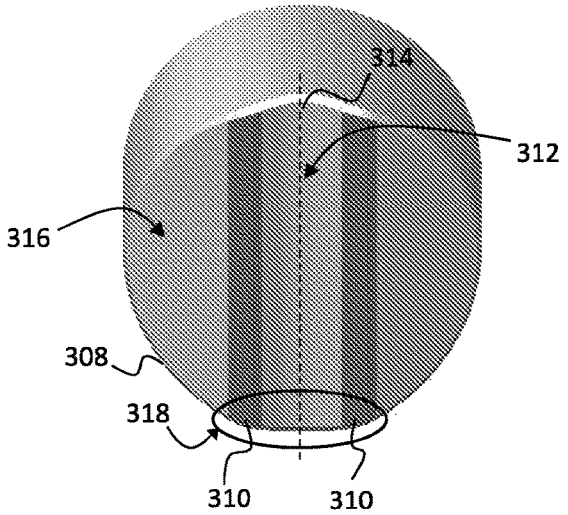

Referring to FIGS. 3-5, several views are provided of a non-planar cutting element according to some embodiments of the present disclosure. FIGS. 3-5 show a cutting element 300 having an ultrahard layer 302 and a substrate 304 (not shown separately in FIGS. 4 and 5). An upper or top surface of ultrahard layer 302 forms a non-planar working surface 306 of the cutting element. The ultrahard layer 302 has a peripheral edge 308 surrounding (and defining the bounds of) working surface 306. The working surface 306 has a plurality of cutting crests 310 separated by a valley 312 therebetween. As used herein, the crest refers to a portion of the non-planar cutting element that includes the peak(s), elevated height(s), and/or convex portions of the cutting element, which extends in a generally elongated fashion, such as, but not limited to, from one side of the cutting element to the other. In one or more other embodiments, the plurality of cutting crests 310 may extend less than the diameter of the substrate 304 or even greater than the diameter of the substrate 304.

As illustrated, a centerline 314 extends between the plurality of crests 310, and in some embodiments, the valley 312 may (but does not necessarily) coincide or overlap with the centerline. Centerline 314 extends a diameter of cutting element and as referred to herein, is selected (as compared to any other line extending along a diameter of the cutting element from other points around the circumference of the cutting element) based on alignment with the plurality of cutting crests, which, in the illustrated embodiment is substantially parallel with and a line of symmetry for the plurality of cutting crests. It is appreciated that other embodiments may involve, for example, non-linear and/or asymmetric crests, in which case the centerline may be selected to be at any location that is between the crests.

On the sides of cutting crests 310 extending away from centerline 314 are canted surfaces 316 (sloped downward, away from the height of cutting crests 310), which may provide for diversion of cuttings during drilling or cutting. The presence of crests 310, valley 312, and canted surfaces 316 results in an undulating peripheral edge 308. The portions of the peripheral edge 308 which are proximate the crests 310 on either side of the cutting element 300 form a cutting edge portion 318. Canted surfaces 316 may be sloped, relative to a plane that is perpendicular to a central axis of the cutting element, at an angle that ranges from 5° to 60°. In other embodiments, the angle may be within a range having a lower limit, an upper limit, or both lower and upper limits including any of 30°, 40°, 50°, 60°, or values therebetween. As shown in FIG. 3, a width W may be measured between peaks of the plurality of cutting crests 310. The width W spanned by the plurality of cutting elements, relative to a diameter of the substrate 304 (or width of a the substrate 304 for a non-cylindrical substrate 304), may range from 10% to 70%, or at least 20°, 30°, or 40° and up to 40°, 50°, or 60°. The width W may be described as the width of cutting edge portion 318, given that the ends of the crests 310 (at peripheral edge 308 and cutting edge portion 318, specifically) are designed to interact with the formation.

In one or more embodiments, the height differential $H_1$ between the lowest point of canted surface 316 and the highest point of adjacent crest 310*a* is greater than the height differential $H_2$ between the highest point of that same crest 310*a* and the valley 312 extending away from that crest 310*a* towards centerline 314. In one or more embodiments, the height differential $H_1$ between a crest 310 and an adjacent canted surface 316 may range from 0.060 to 0.180 in. (1.52 to 4.57 mm). The lower limit, the upper limit, or both the lower and upper limit may include any of 0.060, 0.080, 0.10, 0.12, 0.15, 0.16, 0.17, 0.18 in. (1.52, 2.03, 2.54, 3.05, 3.81, 4.06, 4.32, or 4.57 mm), or any values therebetween. In some embodiments, the height differential $H_2$ between a crest 310 and an adjacent valley 312 may range from 5% to 100% of $H_1$. In one or more embodiments, the lower limit, the upper limit, or the lower and upper limit may include any of 5%, 10%, 20%, 30%, 50%, 60% 70%, 75%, 80%, 90%, 100%, or any values therebetween.

In the illustrated embodiment, the crests 310 each have substantially the same height and are at the substantially same height along their entire length (resulting in a linearly extending crest). In one or more embodiments, the crests 310 may vary in height along their length, but may have substantially the same peak height (such as shown, for example, in the embodiment illustrated in FIGS. 12-15 below). Further, it is also envisioned that the plurality of crests 310 may have different peak heights (whether or not each crest 310 varies in height along its length), such as having a difference of up to 10%, relative to a diameter of the cutting element 300.

Depending on the size of the cutting element, the height $H_3$ of the cutting crest 310 (the height from the interface to the peak of the cutting crest) may range, for example, from 0.1 inch (2.54 mm) to 0.3 inch (7.62 mm). Further, unless otherwise specified, heights of the ultrahard layer (or cutting crests) are relative to the lowest point of the interface of the ultrahard layer and substrate. As shown, the cutting crest 310 has a convex cross-sectional shape (taken along a plane perpendicular to cutting crest length, as apparent from FIG. 3), where the uppermost point of the crest has a radius of curvature that tangentially transitions into the canted surface 316 and valley 312. According to embodiments of the present disclosure, a cutting element working surface may have a cutting crest 310 with a radius of curvature ranging from 0.02 in. (0.51 mm) to 0.300 in. (7.62 mm), or in another embodiment, from 0.06 in. (1.52 mm) to 0.18 in. (4.57 mm). Further, in some embodiments, along a cross-section of each cutting crest 310 extending laterally into a canted surface 316 and valley 312, cutting crest 310 may have an angle 311 formed between the sidewalls that may range from 110° to 160°. Further, depending on the type of upper surface geometry, it is also intended that other crest angles, including down to 60° may also be used. Further, while some embodiments may have a uniform angle 311, radius of curvature for the cutting crest 310, or height $H_3$ along the length of cutting crest 310 and/or between the plurality of cutting crests, the present disclosure is not so limited.

Figure 6:
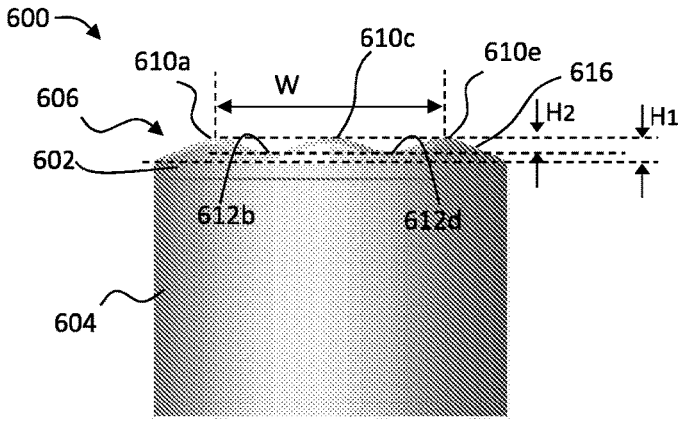
FIGS. 6 and 7 are various views of a cutting element, according to another embodiment of the present disclosure.
Figure 7:
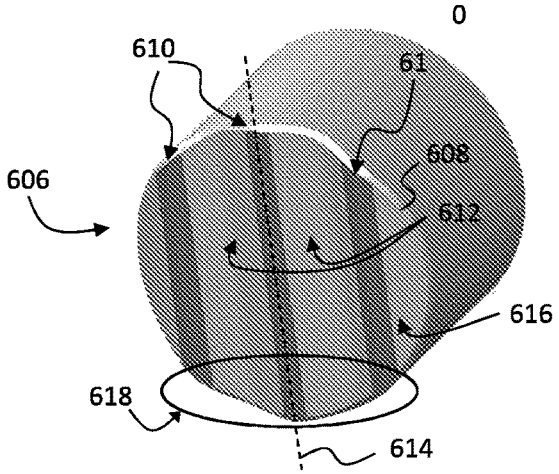

Referring now to FIGS. 6 and 7, another embodiment of a cutting element 600 is shown. Cutting element 600 may include an ultrahard layer 602 and a substrate 604 (not shown separately in FIG. 7). An upper or top surface of ultrahard layer 602 forms a non-planar working surface 606 of the cutting element. The ultrahard layer 602 has a peripheral edge 608 surrounding (and defining the bounds of) working surface 606. The working surface 606 has a plurality of cutting crests 610 separated by a valley 612 therebetween. Specifically, in the embodiment shown, cutting element 600 includes three cutting crests 610 (specifically, 610*a*, 610*c*, and 610*e*) and two valleys 612 (612*b* extending between crests 610*a* and 610*c*, and 612*d* extending between crests 610*c* and 610*e*) each of which extends in a generally elongated fashion from one side of the cutting element to the other. In this embodiment, a centerline 614 coincides with cutting crest 610*c*.

On the sides of cutting crests 610*a*, 610*e* (the outer cutting crests, as compared to inner cutting crest 616*c*) extending away from centerline 614 are canted surfaces 616 (sloped downward, away from the height of cutting crests 610), which may provide for cuttings diversion during drilling or cutting. The presence of crests 610, valleys 612, and canted surfaces 616 results in an undulating peripheral edge 608. The portions of the peripheral edge 608, which are proximate the crests 610 on either side of the cutting element 600 form a cutting edge portion 618. As described with respect to FIGS. 3-5, canted surfaces 616 may be sloped, relative to a plane that is perpendicular to a central axis of the cutting element, at an angle that ranges from 5° to 60°. In other embodiments, the angle may be within a range having a lower limit, an upper limit, or both lower and upper limits including any of 30°, 40°, 50°, 60°, or values therebetween. As shown in FIG. 6, a width W may be measured as the distance between peaks of the plurality of cutting crests 610. The width W spanned by the plurality of cutting elements, relative to a diameter of the substrate 604, may range from 10% to 70% of the diameter or at least 20°, 30°, or 40°, up to 40°, 50°, or 60°.

Further, similar to other embodiments discussed herein, a height differential $H_1$ between the lowest point of canted surface 616 and the highest point of adjacent crest 610*a* is greater than the height differential $H_2$ between the highest point of that same crest 610*a* and the valley 612 extending away from that crest 610*a* towards centerline 614. In one or more embodiments, the height differential $H_1$ between a crest 610 and an adjacent canted surface 616 may range from 0.060 to 0.180 in. (1.52 to 4.57 mm). The lower limit, upper limit, or lower and upper limits may be any of 0.060, 0.080, 0.10, 0.12 0.15, 0.16, 0.17, 0.18 in. (1.52, 2.03, 2.54, 3.05, 3.81, 4.06, 4.32, or 4.57 mm), or any values therebetween. In one or more embodiments, the height differential $H_2$ between a crest 610*a* and valley 612*b* may range from 5% to 100% of $H_1$. In one or more embodiments, the lower limit, the upper limit, or the lower and upper limits may be any of 5%, 10%, 20%, 30%, 50%, 60%, 70%, 75%, 80%, 90%, 100%, or any values therebetween.

In the illustrated embodiment, the crests 610 each have substantially the same height and are at substantially the same height along their entire length (resulting in a linearly extending crest). In some embodiments, the crests 610 may vary in height along their length, but may have substantially the same peak height as one another. Further, it is also envisioned that the plurality of crests 610 may have different peak heights (whether or not each crest 610 varies in height along its length).

Figure 8:
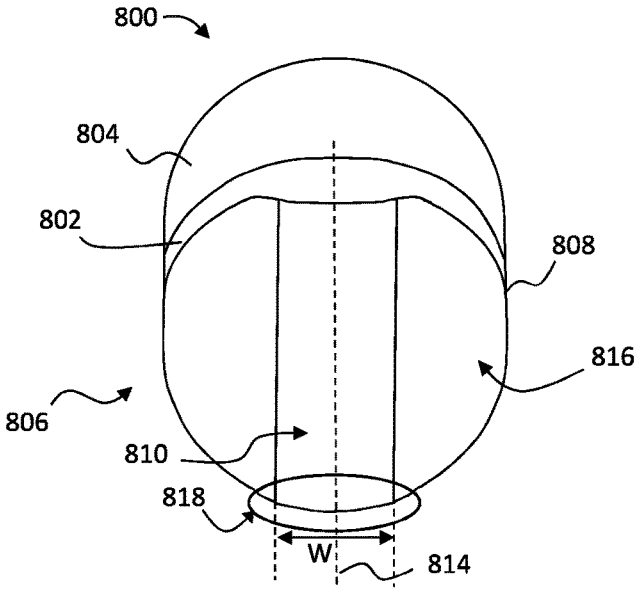
FIG. 8 is a top perspective view of a cutting element, according to further embodiments of the present disclosure.

While other embodiments described herein may include a cutting crest having a curvature at its upper peak, the present disclosure is not so limited. As shown in FIG. 8, a cutting element 800 has an ultrahard layer 802 on a substrate 804. An upper or top surface of ultrahard layer 802 forms a non-planar working surface 806 of the cutting element. The ultrahard layer 802 has a peripheral edge 808 surrounding (and defining the bounds of) working surface 806. The working surface 806 has a cutting crest 810, which extends in a generally elongated fashion from one side of the cutting element to the other. In this embodiment, cutting crest 810 may have a plateau or substantially planar face for at least a portion of its width. Thus, in such embodiments, the cutting crest 810 may have a substantially infinite radius of curvature. In such embodiments, the plateau may have a radius-based transition into the sidewalls that extend to form canted surfaces 816. In one or more embodiments, the plateau of planar cutting crest 810 may be substantially perpendicular to a central axis (not shown) of the cutting element 800; however, in other embodiments, it may be at a non-perpendicular angle relative to the central axis (not shown).

A centerline 814 extends through crest 810. On the lateral sides of cutting crest 810, extending away from centerline 814, are canted surfaces 816. The presence of crest 810 and canted surfaces 816 results in an undulating peripheral edge 808. The portions of the peripheral edge 808 which are proximate the crest 810 on either side of the cutting element 800 form a cutting edge portion 818. Canted surfaces 816 may be sloped, relative to a plane that is perpendicular to a central axis 812 of the cutting element, at an angle that ranges from 5° to 60°. In other embodiments, the angle may be within a range having a lower limit, an upper limit, or both lower and upper limits including any of 30°, 40°, 50°, 60°, or values therebetween. As shown in FIG. 8, a width W spanned by the cutting crest 810, relative to a diameter of the substrate 804, may range from 10% to 70% of the diameter, or at least 20°, 30°, or 40° up to 40°, 50°, or 60°. Further, while not specifically illustrated, a height differential $H_1$ between the cutting crest 810 and the lowest point on canted surface 816 may range from 0.060 to 0.180 in. (1.52 to 4.57 mm).

Figure 9:
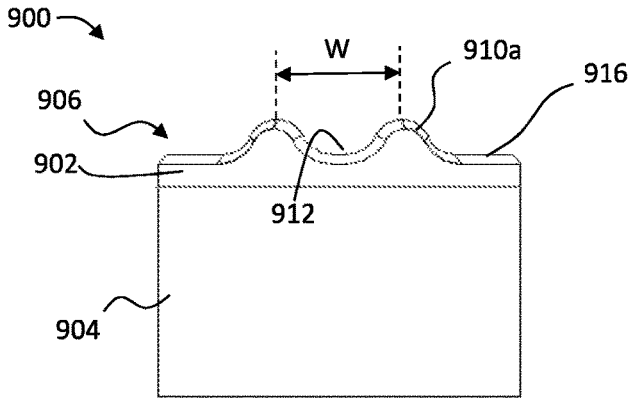
FIGS. 9-11 are various views of a cutting element, according to additional embodiments of the present disclosure.
Figure 10:
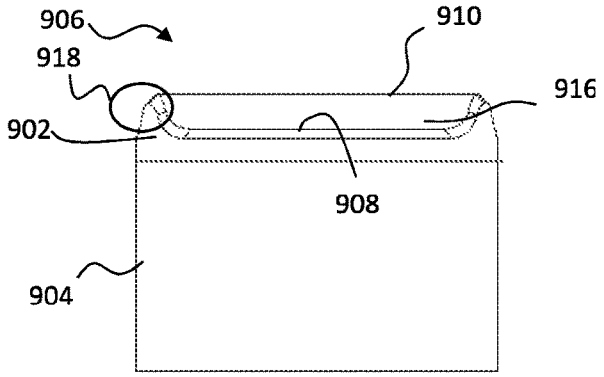
Figure 11:
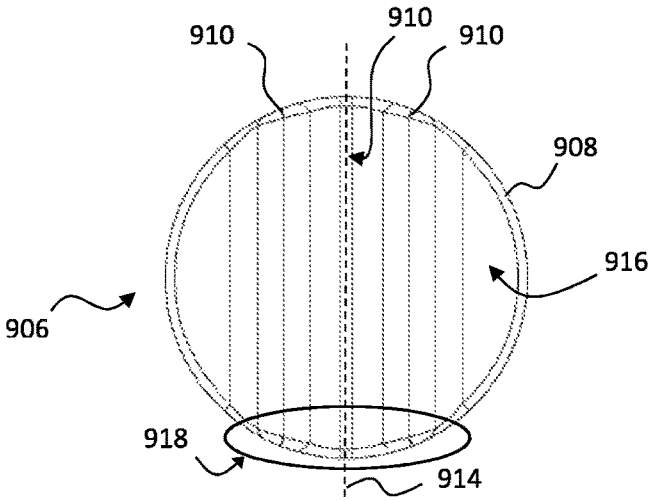
Figure 12:
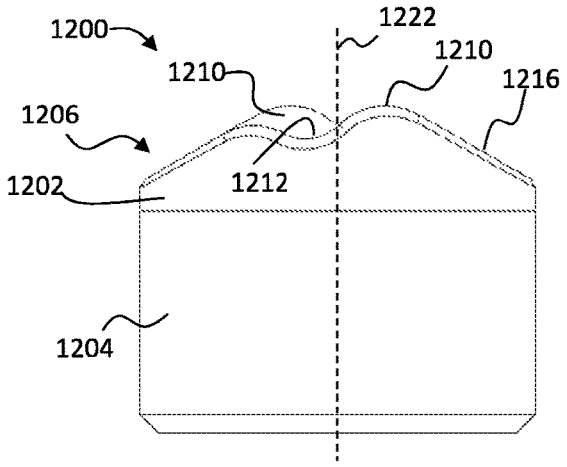
FIGS. 12-15 are various views of a cutting element, according to some embodiments of the present disclosure.
Figure 13:
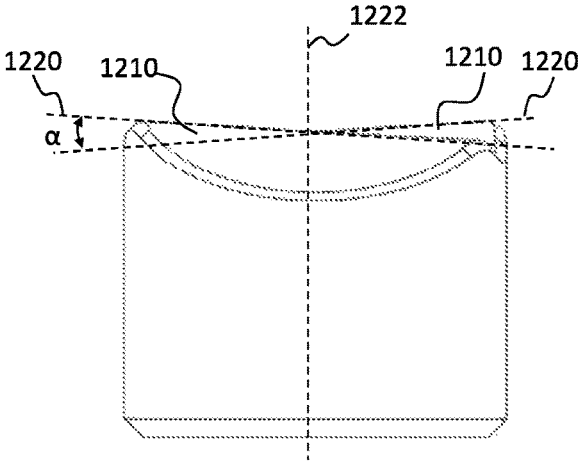

Referring now to FIGS. 9-11, another embodiment of a cutting element 900 is shown. Cutting element 900 includes ultrahard layer 902 on a substrate 904. An upper or top surface of ultrahard layer 902 forms a non-planar working surface 906 of the cutting element. The ultrahard layer 902 has a peripheral edge 908 surrounding (and defining the bounds of) working surface 906. The working surface 906 has a plurality of cutting crests 910, which extend in a generally elongated fashion from one side of the cutting element to the other, and which are separated by a valley 912. As illustrated, a centerline 914 extends between the crests 910 and coincides with valley 912. On the sides of cutting crests 910 extending away from centerline 914 are planar landings 916 (which are substantially perpendicular to a central axis of the cutting element 900), which may provide for cuttings diversion during drilling or cutting.

As shown in FIG. 9, a width W may be measured between peaks of the plurality of cutting crests 310. The width W spanned by the plurality of cutting elements, relative to a diameter of the substrate 304, may range from 10% to 70% of the diameter, or at least 20°, 30°, or 40° up to 40°, 50°, or 60°. In one or more embodiments, the height differential $H_1$ between a crest 910 and an adjacent canted surface 916 may range from 0.060 to 0.180 in. (1.52 to 4.57 mm). The lower limit, the upper limit, or the lower and upper limits may be any of 0.060, 0.080, 0.10, 0.12 0.15, 0.16, 0.17, 0.18 in. (1.52, 2.03, 2.54, 3.05, 3.81, 4.06, 4.32, or 4.57 mm), or values therebetween. In one or more embodiments, the height differential $H_1$ between the planar landing 916 and the highest point of adjacent crest 910*a* is greater than the height differential $H_2$ between the highest point of that same crest 910*a* and the valley 912 extending away from that crest 910*a* towards centerline 914. In one or more embodiments, the height differential $H_2$ between a crest 910 and an adjacent valley 912 may range from 5% to 100% of $H_1$. In one or more embodiments, the lower limit, the upper limit, or the lower and upper limits may be any of 5%, 10%, 20%, 30%, 50%, 60%, 70%, 75%, 80%, 90%, 100%, or any values therebetween.

Referring now to FIGS. 12-15, another embodiment of a cutting element 1200 is shown. Cutting element 1200 includes ultrahard layer 1202 on a substrate 1204. An upper or top surface of ultrahard layer 1202 forms a non-planar working surface 1206 of the cutting element 1200. The ultrahard layer 1202 has a peripheral edge 1208 surrounding (and defining the bounds of) working surface 1206. The working surface 1206 has a plurality of cutting crests 1210, which extends in a generally elongated fashion from one side of the cutting element to the other, and which are separated by a valley 1212. The crests 1210 may have height differentials and a spanned width relative to cutting element (or substrate) diameter as discussed herein. Unlike some other embodiments described herein, the plurality of cutting crests 1210 have varying heights along their lengths. As a result, lines 1220 extending along the length of each of cutting crests 1210 ("crest lines") are on distinct planes from one another. When the crest lines 1220 are projected into a plane on which a central axis 1222 of the cutting element lies (shown in FIG. 13), an angle α between lines 1220 ranges from greater than 0° to 20°. Other embodiments may include an angle α within a range having a lower limit, an upper limit, or lower and upper limits including any of 1°, 2°, 5°, 8°, 10°, 12°, 15°, 18°, 20°, or any values therebetween. When crest lines 1220 are projected into plane that is perpendicular to a central axis 1222 of cutting element 1200 (shown in FIG. 14), the crest lines may be substantially parallel to each other. In one or more embodiments, the crest lines (when projected onto a plane that is perpendicular to central axis 1222), the crest lines are not parallel.

As illustrated, a centerline 1214 extends between crests 1210, but unlike some other embodiments described herein, the centerline 1214 may not coincide with (or pass through) valley 1212. Rather, valley 1212 is angled relative to centerline 1214 as well as crests 1210. Specifically, a line 1224 extending through the length of valley 1212 ("valley line") may be angled relative to crest lines 1220, when all of the lines are projected onto a plane that is perpendicular to a central axis 1222. In some embodiments, projected angle β ranging from 5° to 20° is formed between valley line 1224 and each of the crest lines 1220. Some embodiments may include a projected angle β within a range having a lower limit, an upper limit, or lower and upper limits including any of 5°, 6°, 7°, 10°, 12°, 15°, 18°, 20°, or any values therebetween. In some embodiments, where the crest lines 1220 are parallel to each other, the valley line 1224 may form the same angle with each of the crest lines 1220; however, the angles may vary when the crest lines are line parallel to each other.

Figure 14:
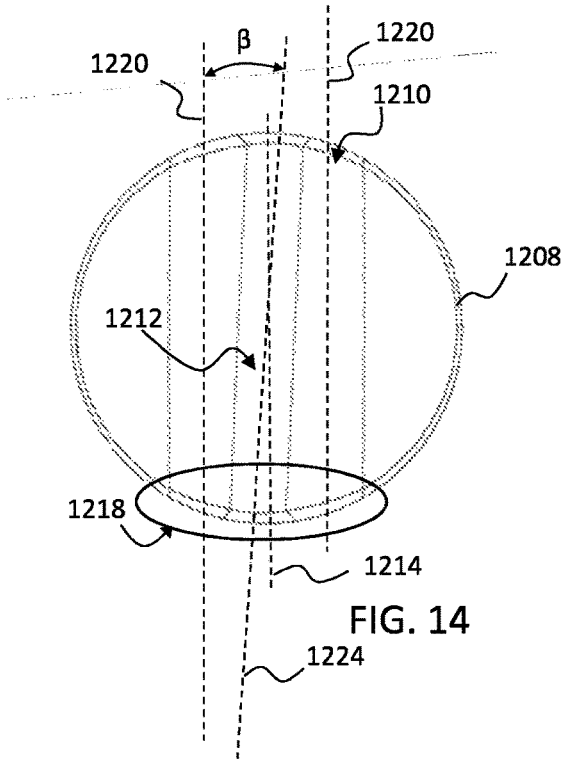
Figure 15:
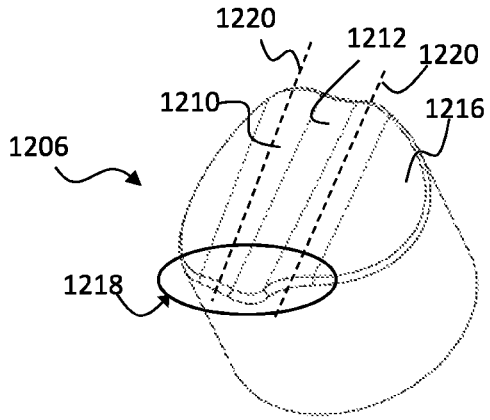
Figure 16:
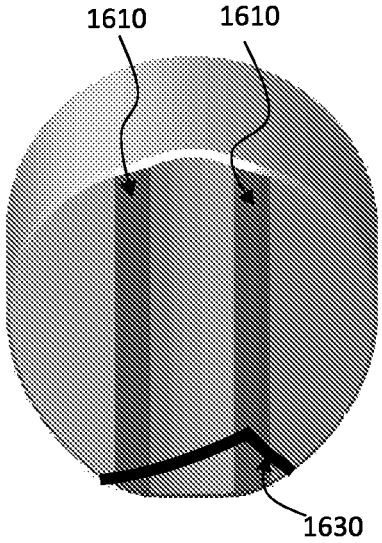
FIG. 16 is a top perspective view of a cutting element, according to another embodiment of the present disclosure.

The angle of the valley 1212 relative to the crests 1210 may result in asymmetrical widths of each crest 1210 (for a given cutting edge portion), as shown in FIG. 14. Such asymmetrical crests 1210 may, however, also be used in combination with any of the other embodiments described herein. In some embodiments, the asymmetrical crests 1210 may be used so that the wider crest 1210 experiences the highest depth of cut when engaging with the formation. Similarly, such alignment of a crest 1210 with the expected highest depth of cut may also occur for other types of asymmetry, such as crests of even width but varying distance from a centerline, or for symmetrical crests as well, as shown, for example, in FIG. 16. Specifically FIG. 16 shows alignment of cutting crest 1610 with peak of expected depth of cut 1630.

Figure 17:
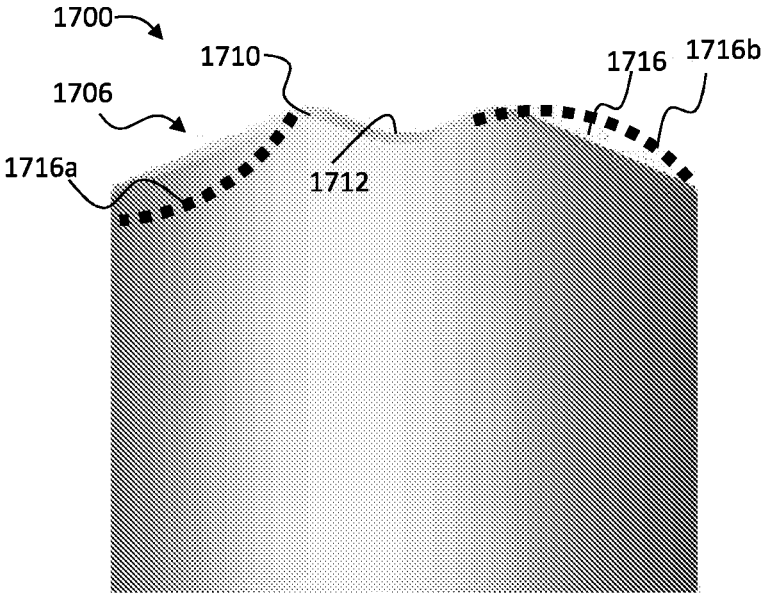
FIG. 17 is a side view of a cutting element, according to further embodiments of the present disclosure.

In at least some of the other embodiments described herein, a cross-section of each cutting crest may also be described as the cross-section of a cone with a rounded apex, i.e., two angled sidewalls tangentially transitioning into the rounded apex (having the radius of curvature ranges described herein). In the same or other embodiments, sidewalls with curvature (e.g., concave, convex, or combinations thereof) may be used. Specifically, as shown in FIG. 17, a non-planar working surface 1706 of cutting element 1700 may include a plurality of cutting crests 1710 with a valley 1712 therebetween. Canted surfaces 1716 extend laterally from cutting crests 1710, away from a centerline (not shown, but coinciding with valley 1712 in the illustrated embodiment). As shown, canted surface 1716*a* may be concave and canted surface 1716*b* may be convex and each may be used in place of a planar canted surface 1716. Other embodiments may use various combinations of concave, convex, or planar surfaces.

Figure 18:
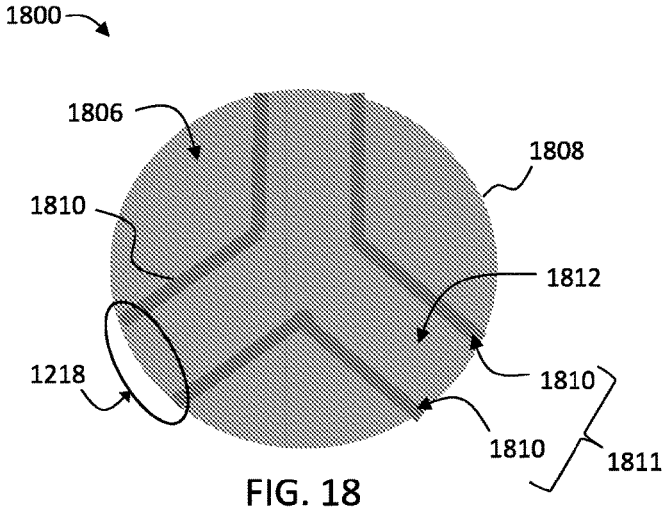
FIG. 18 is a top view of a cutting element, according to additional embodiments of the present disclosure.
Figure 19:
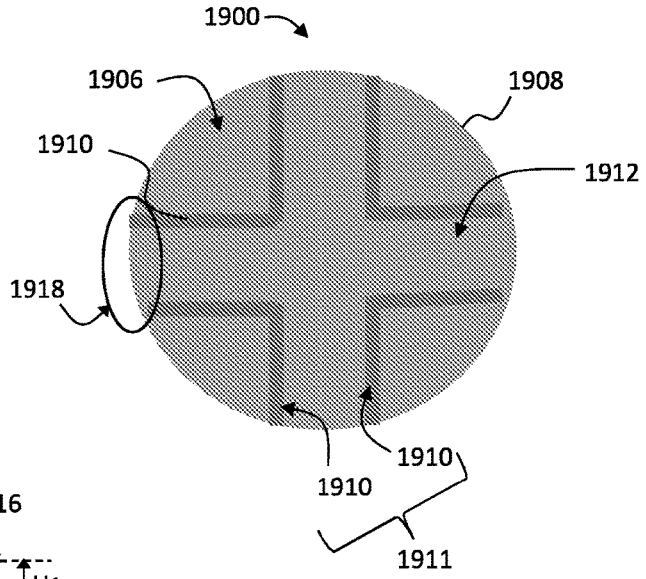
FIG. 19 is a top view of a cutting element, according to some embodiments of the present disclosure.

At least some of the previously discussed embodiments may include a cutting crest extending from one side of a cutting element to the other, with a length that may be slightly less than a diameter of the cutting element. As discussed herein, the present disclosure is not so limited. For example, referring to FIGS. 18 and 19, additional embodiments of cutting elements are shown. FIG. 18 shows a cutting element 1800 having a non-planar working surface 1806 that is surrounded by (and the bounds of which are defined by) a peripheral edge 1808. Working surface 1806 is formed of a plurality of cutting crests 1810 and a valley 1812 between the plurality of cutting crests 1810, and the portions of the undulating peripheral edge 1808 which are proximate the crests 1810 form cutting edge portions 1818. In this embodiment, there are three "sets" 1811 of cutting crests 1810, forming three cutting edge portions 1818. In some other embodiments described herein, there may be two cutting edge portions, however, because the cutting crests extend across the entire working surface of the cutting element, there are not distinct sets of cutting crests; rather each crest has two cutting edge portions. In the embodiment illustrated in FIG. 18, each "set" 1811 of cutting crests extends towards a central or interior region of the working surface 1806 (without extending to the other side of the cutting element) and optionally intersects other "sets". Thus, each crest 1810 forms a single cutting edge portion. Each "set" 1811 of cutting crests 1810 includes a plurality (two as illustrated) of cutting crests 1810. Referring now to FIG. 19, another embodiment of a cutting element 1900 is shown. In this embodiment, cutting element 1900 has a non-planar working surface 1906 that is surrounded by (and the bounds of which are defined by) an undulating peripheral edge 1908. Working surface 1906 is formed of a plurality of cutting crests 1910 and a valley 1912 between the plurality of cutting crests 1910, and the portions of the peripheral edge 1908 which are proximate the crests 1910 form cutting edge portions 1918. In this embodiment, there are four "sets" 1911 of cutting crests 1910, forming four cutting edge portions 1918.

Figure 20:
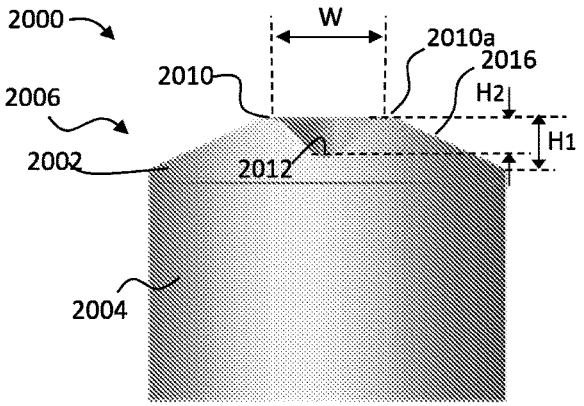
FIGS. 20 and 21 are various views of a cutting element according to further embodiments of the present disclosure FIG. 22 schematically illustrates various modes of fracture.
Figure 21:
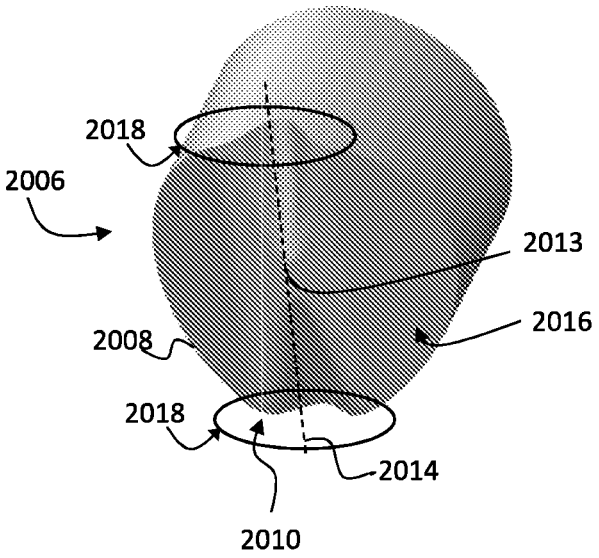
Figure 22:
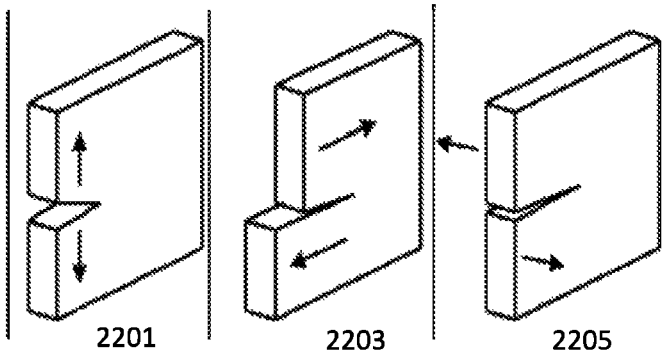

Referring now to FIGS. 20 and 21, another embodiment of a cutting element is shown. FIGS. 20 and 21 show a cutting element 2000 having an ultrahard layer 2002 and a substrate 2004 (not shown separately in FIGS. 21 and 22). An upper or top surface of ultrahard layer 2002 forms a non-planar working surface 2006 of the cutting element 2000. The ultrahard layer 2002 has a peripheral edge 2008 surrounding (and defining the bounds of) working surface 2006. The working surface 2006 has a plurality of cutting crests 2010 separated by a valley 2012 therebetween. In the embodiment shown, the plurality of cutting crests 2010 form two distinct crests at the peripheral edge 2008 (on each side of the cutting element 2000) but at an interior region of the cutting element 2000 and working surface 2006, the cutting crests 2010 are bridged together 2013. Thus, there are in fact two valleys 2012, each one on opposite sides of the cutting element 2000 between the cutting crests 2010. Valleys 2012 are illustrated as being sloped upward (i.e., away from the substrate 2004) from the peripheral edge 2008, increasing in height relative to the substrate 2004 as the distance from a central axis of the cutting element 2000 decreases, so that the working surface 2006 transitions from valley 2012 to bridge 2013. In one or more embodiments, however, valley 2012 may be curved along its length to transition into bridge 2013. Further, while not illustrated, it is also envisioned that the sloped or curved valley (relative to the crest) may be used on working surfaces in which no bridge is present between cutting crests. Thus, a line extending through the length of valley, when transposed onto a plane (parallel to a central axis of the cutting element and on which centerline 2014 lies) on which a crest line (extending through each end of cutting crest) lays, may be angled relative to the crest line (and optionally intersect). It is believed that these types of valleys 2012 may aid in removal of cuttings away from the working surface 2006.

On the sides of cutting crests 2010*a* extending away from centerline 2014 are canted surfaces 2016 (sloped downward, away from the height of cutting crests 2010), which may provide for cuttings diversion during drilling or cutting. The presence of crests 2010, valleys 2012, and canted surfaces 2016 results in an undulating peripheral edge 2008. The portions of the peripheral edge 2008 that are proximate the crests 2010 on either side of the cutting element 2000 form a cutting edge portion 2018. As described with respect to FIGS. 3-5, canted surfaces 2016 may be sloped, relative to a plane that is perpendicular to a central axis of the cutting element, at an angle that ranges from 5° to 60°. A width W may be measured between peaks of the plurality of cutting crests 2010. The width W spanned by the plurality of cutting elements, relative to a diameter of the substrate 2004, may range from 10% to 70% of the diameter or at least 20°, 30° or 40° and up to 40°, 50°, or 60°.

Further, similar to other embodiments described herein, a height differential $H_1$ between the lowest point of canted surface 2016 and the highest point of adjacent crest 2010*a* is greater than the height differential $H_2$ between the highest point of that same crest 2010*a* and the valley 2012 extending away from that crest 2010*a* towards centerline 2014. In one or more embodiments, the height differential $H_1$ between a crest 2010 and an adjacent canted surface 2016 may range from 0.060 to 0.180 in. (1.52 to 4.57 mm). The lower limit, the upper limit, or the lower and upper limits may be any of 0.060, 0.080, 0.10, 0.12 0.15, 0.16, 0.17, 0.18 in. (1.52, 2.03, 2.54, 3.05, 3.81, 4.06, 4.32, or 4.57 mm), or any values therebetween. In some embodiments, the height differential $H_2$ between a crest 2010*a* and valley 2012 may range from 5% to 100% of $H_1$. In one or more embodiments, the lower limit, the upper limit, or the lower and upper limits may be any of 5%, 10%, 20%, 30%, 50%, 60%, 70%, 75%, 80%, 90%, 100%, or any values therebetween.

In one or more embodiments, the embodiments of the present disclosure may advantageously allow for fracturing of rock by multiple fracture modes, and in some embodiments, may advantageously allow for fracturing by all three types of fracturing modes. These fracturing modes, shown in FIG. 22, include Fracture Mode I 2201 (an Opening mode due to a tensile stress normal to the plane of the crack); Fracture Mode II 2203 (a Sliding mode due to a shear stress acting parallel to the plane of the crack and perpendicular to the crack front); and Fracture Mode III 2205 (a Tearing mode due to shear stress acting parallel to the plane of the crack and parallel to the crack front). While conventional PDC cutters fracture rock by Fracture Mode II, the incorporation of cutting crests into a cutting element may allow for fracturing by Fracture Mode I, and incorporation of angled cutting crests and/or angled valleys between crests may allow for fracturing by Fracture Mode III.

Substrates according to embodiments of the present disclosure may be formed of cemented carbides, such as tungsten carbide, titanium carbide, chromium carbide, niobium carbide, tantalum carbide, vanadium carbide, or combinations thereof cemented with iron, nickel, cobalt, or alloys thereof. For example, a substrate may be formed of cobalt-cemented tungsten carbide. Ultrahard layers according to embodiments of the present disclosure may be formed of, for example, polycrystalline diamond, such as formed of diamond crystals bonded together by a metal catalyst such as cobalt or other Group VIII metals under sufficiently high pressure and high temperatures (sintering under HPHT conditions), thermally stable polycrystalline diamond (polycrystalline diamond having at least some or substantially all of the catalyst material removed), or cubic boron nitride. Further, it is also within the scope of the present disclosure that the ultrahard layer may be formed from one or more layers, which may have a gradient or stepped transition of diamond content therein. In such embodiments, it is intended that one or more transition layers (as well as the other layer) may include metal carbide particles therein. Further, when such transition layers are used, the combined transition layers and outer layer may collectively be referred to as the ultrahard layer, as that term has been used in the present application. That is, the interface surface on which the ultrahard layer (or plurality of layers including an ultrahard material) may be formed is that of the cemented carbide substrate. Further, while certain interfaces may not be described herein, it is intended that any type of interface may be used, including planar and non-planar interfaces.

Figure 2:
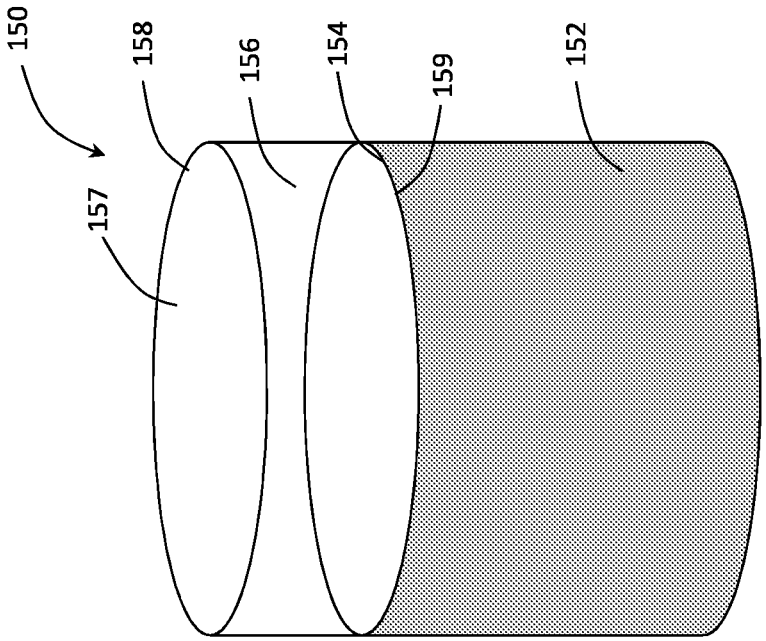
FIG. 2 is a front perspective view of a PDC cutter, according to some embodiments of the present disclosure.
Figure 1:
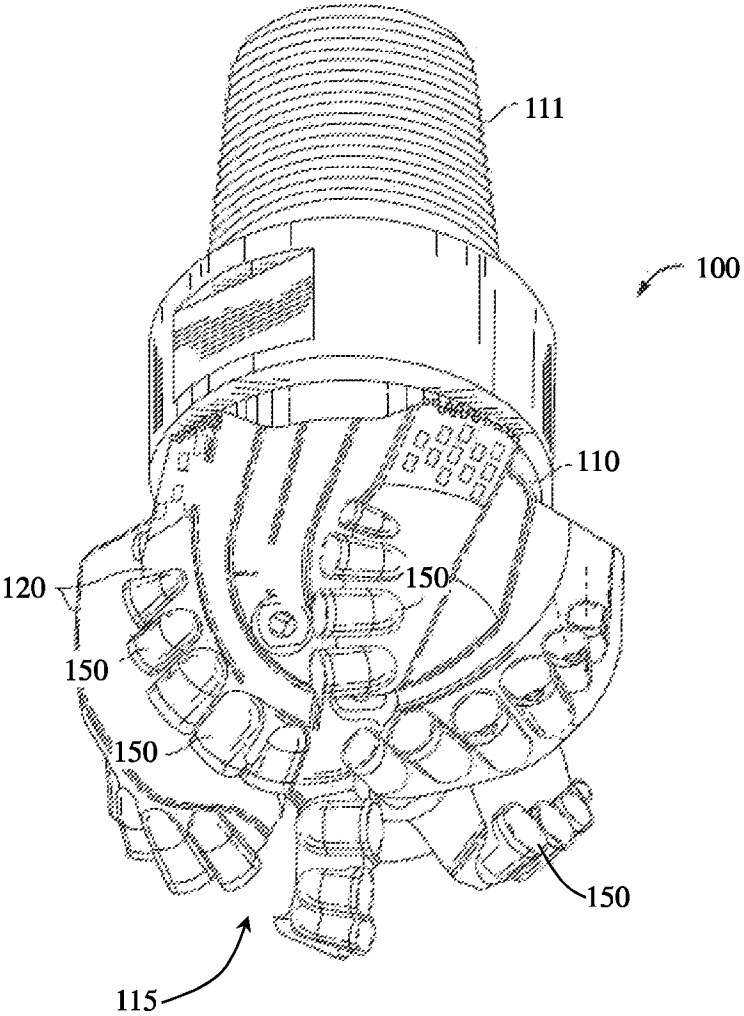
FIG. 1 is a perspective view of a fixed cutter drill bit, according to some embodiments of the present disclosure.

The cutting elements described herein may be used on a drill bit, such as the type shown in FIG. 1. Cutting elements of the embodiments of the present disclosure may be used in any location along the cutting profile of a bit (i.e., at any radial distance from the bit axis), and one, some, or all cutting elements may be of the same type, may be of different types described herein, or may include other cutting element types. Thus, cutting elements of the present disclosure may be used in combination with other types of planar or non-planar working surfaces, including cutting elements with a single crest or pointed cutting elements, as well as with conventional cutters with planar working surfaces. As discussed herein, the distance of the cutting crest from a centerline may be selected, in part, based on the cutting/wear profile expected for a given cutting element location on a bit. Thus, it is envisioned that the placement of the cutting elements may be selected based on the cutting/wear profile and varying embodiments of the cutting elements of the present disclosure may be used together based on cutting element location. Further, it is intended that the cutting elements of the present disclosure may be used as a primary and/or back-up cutting element. Further, the cutting elements of the present disclosure may be used with conventional side rake angles and at back rake angles ranging from 5° to 85°. Such rake angle may be as the angle between a plane perpendicular to the central axis of the cutting element and a line that is normal to the formation being cut.

Figure 23:
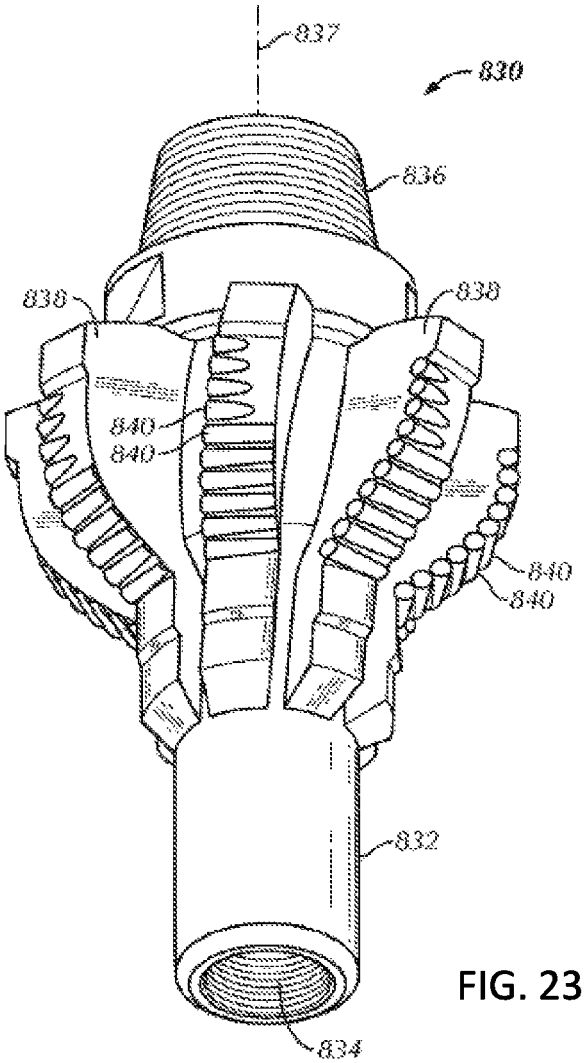
FIG. 23 is a perspective view of a hole opener, according to some embodiments of the present disclosure.

Further, it is also intended that the cutting elements may be used on other types of downhole tools, including for example, a reamer, hole opener, mill, or the like. FIG. 23 shows a hole opener 830 that includes one or more cutting elements of the present disclosure. The hole opener 830 includes a tool body 832 and a plurality of blades 838 at selected azimuthal locations about a circumference thereof. The hole opener 830 generally comprises connections 834, 836 (e.g., threaded connections) so that the hole opener 830 may be coupled to adjacent drilling tools that comprise, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown).

It should be understood that while elements or features are described herein in relation to depicted embodiments, each element or feature may be combined with other elements of other embodiments. Also, while embodiments of cutting elements and cutting tools have been primarily described with reference to downhole tools, the devices described herein may be used in applications other than the drilling or downhole environments. In other embodiments, cutting elements according to the present disclosure may be used outside a wellbore or other downhole environment used for the exploration or production of natural resources. For instance, tools and assemblies of the present disclosure may be used in a wellbore used for placement of utility lines, or other industries (e.g., aquatic, manufacturing, automotive, etc.). Accordingly, cutting elements, devices, tools, systems, assemblies, or methods of the present disclosure are not limited to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where a range of values includes various lower and/or upper limits, any two values may define the bounds of the range (e.g., 10% to 50%, or any single value may define an upper limit (e.g., up to 50%) or a lower limit (at least 50%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. The present disclosure may therefore be embodied in other specific forms without departing from the spirit or characteristics of the present disclosure. The described embodiments are to be considered as illustrative and not restrictive, and the scope of the disclosure is indicated by the appended claims rather than by the foregoing description.

Changes that come within the meaning and range of equivalency of the claims are to be embraced within their scope. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

What is claimed is:

1. A cutting element, comprising:

a substrate; and an ultrahard layer on the substrate, the ultrahard layer including a non-planar working surface surrounded by a peripheral edge having a varying height around a circumference of the cutting element, the working surface also having:

a plurality of cutting crests extending from an elevated portion of the peripheral edge across at least a portion of the working surface;

at least one valley between the plurality of cutting crests from a first valley portion of the peripheral edge across at least a portion of the working surface to a second valley portion of the peripheral edge; and a canted surface extending laterally from each of the plurality of cutting crests toward a depressed portion of the peripheral edge, a height between the depressed portion and the elevated portion being greater than a height between the elevated portion and the valley, the canted surface forming an angle with respect to a plane perpendicular to a central axis of the cutting element, the angle being at least 30°.

2. The cutting element of claim 1, the angle being at least 40°.

3. The cutting element of claim 1, each of the plurality of cutting crests having a substantially equal peak height.

4. The cutting element of claim 1, the plurality of cutting crests including a plurality of sets of cutting crests intersecting each other at an interior region of the working surface.

5. The cutting element of claim 1, the plurality of cutting crests being asymmetrically placed with respect to a centerline between the crests.

6. The cutting element of claim 1, the at least one valley being sloped or curved relative to the plurality of cutting crests.

7. A cutting element, comprising:

a substrate; and an ultrahard layer on the substrate, the ultrahard layer including a non-planar working surface surrounded by a peripheral edge having a varying height around a circumference of the cutting element, wherein the peripheral edge comprises a cutting edge portion and lateral sides, the lateral sides orthogonal to the cutting edge portion, the working surface also having:

at least one cutting crest extending from an elevated portion of the cutting edge portion of the peripheral edge across the working surface to another elevated portion of the peripheral edge, a crest width across a centerline of the cutting element spanned by the least one cutting crest ranging from 10% to 70% of a width of the substrate, wherein the elevated portion of the cutting edge portion extends a height above the lateral sides, the at least one cutting crest comprises a canted surface extending laterally away from the centerline to a continuous surface comprising one of the lateral sides, and the crest width extends across a central axis of the substrate and the ultrahard layer of the cutting element.

8. The cutting element of claim 7, the at least one cutting crest having a substantially planar surface extending the crest width.

9. The cutting element of claim 7, the at least one cutting crest including a plurality of cutting crests and the crest width spanned being a distance between peaks of the plurality of cutting crests.

10. The cutting element of claim 7, the continuous surface including at least one planar landing that is substantially perpendicular to the central axis of the cutting element and laterally outside of the at least one cutting crest.

11. The cutting element of claim 7, the at least one cutting crest including a plurality of cutting crests and at least one valley, wherein the height of the elevated portion of the cutting edge portion above the lateral sides is greater than a second height of the elevated portion above at least one valley.

12. The cutting element of claim 11, wherein the second height is between 5 to 100% of the height of the elevated portion of the cutting edge portion above the lateral sides.

13. A cutting element, comprising:

a substrate; and an ultrahard layer on the substrate, the ultrahard layer including a non-planar working surface surrounded by a peripheral edge having a varying height around a circumference of the cutting element, the working surface also having:

a plurality of cutting crests extending from an elevated portion of the peripheral edge across the working surface to another elevated portion of the peripheral edge, and in which crest lines extending through each of the plurality of cutting crests are on distinct planes from one another; and at least one valley between the plurality of cutting crests, a valley line extending through the at least one valley not being parallel to the crest lines.

14. The cutting element of claim 13, wherein a projection of the valley line and the crest lines onto a plane that is perpendicular to a central axis of the cutting element includes the valley line forming an angle within a range of 5° to 20° relative to each of the crest lines.

15. The cutting element of any of claim 13, wherein a projection of the crest lines onto a plane that is perpendicular to a central axis of the cutting element includes crest lines that are substantially parallel to each other.

16. The cutting element of claim 13, wherein a projection of the crest lines onto a single plane on which a central axis of the cutting element lies, includes crest lines forming an angle relative to each other ranging from greater than 0° to 10°.

17. The cutting element of claim 13, the plurality of cutting crests have differing widths.

18. The cutting element of claim 13, each valley of the at least one valley having a valley line or curve extending through a length thereof, the valley line or curve being angled relative to the crest line of each of the plurality of cutting crests.

19. The cutting element of claim 18, the working surface also including a bridge between the plurality of cutting crests in an interior region of the working surface.

20. The cutting element of claim 19, the valley line being sloped upward from the peripheral edge to the bridge.

* * * * *